US005112215A

United States Patent [19]

Frish et al.

[11] Patent Number: 5,112,215

[45] Date of Patent: May 12, 1992

[54] APPARATUS FOR COMBUSTION, POLLUTION AND CHEMICAL PROCESS CONTROL

[75] Inventors: Michael B. Frish, Andover; Joseph Morency, Salem; Stephen A. Johnson; Arthur A. Boni, both of Andover, all of Mass.

[73] Assignee: Physical Sciences, Inc., Andover, Mass.

[21] Appl. No.: 724,540

[22] Filed: Jun. 20, 1991

[51] Int. Cl.[5] ..... F23J 7/00

[52] U.S. Cl. ..... 431/3; 431/4; 431/76; 236/15 E; 356/417

[58] Field of Search ..... 431/76, 3, 4; 236/15 E; 356/315, 417

[56] References Cited

U.S. PATENT DOCUMENTS

| | | | |
|---|---|---|---|
| 2,407,838 | 9/1946 | Kliever | 236/15 E |
| 2,727,203 | 12/1955 | Zeitlin et al. | 236/15 E |
| 2,730,005 | 1/1956 | Vonnegut | 356/417 |
| 3,701,622 | 10/1972 | Ducasse | 236/15 E |
| 3,909,132 | 9/1975 | Barrett . | |
| 4,005,605 | 2/1977 | Michael . | |
| 4,018,529 | 4/1977 | Barrett . | |
| 4,043,743 | 8/1977 | Seider | 236/15 E |
| 4,244,684 | 1/1981 | Sperry et al. | 431/4 |
| 4,259,866 | 4/1981 | Sleighter . | |
| 4,272,249 | 6/1981 | D'Antonio . | |
| 4,527,896 | 7/1985 | Irani et al. . | |
| 4,644,173 | 2/1987 | Jeffers . | |
| 4,663,513 | 5/1987 | Webber . | |
| 4,716,843 | 1/1988 | Coerper et al. | 236/15 E |
| 5,010,827 | 4/1991 | Kychakoff et al. | 431/76 |

*Primary Examiner*—Carroll B. Dority

*Attorney, Agent, or Firm*—Testa, Hurwitz & Thibeault

[57] ABSTRACT

Disclosed is a system for regulating the efficiency of a combustion process by detecting radiant energy emitted from ash particles entrained in the gas stream exiting the combustion chamber of a boiler or incinerator. The intensity of selected wavelengths of light emitted from the particles is indicative of the temperature of the particles. The change in the intensities of the selected wavelengths of light, and thus of the temperature of the gas stream at the furnace exit, is monitored, and a feedback control mechanism is used to regulate one or more combustion, pollution control, or heat transfer parameters thereby maximizing the thermal efficiency of the combustion process in the boiler or incinerator.

32 Claims, 5 Drawing Sheets

APPARATUS FOR COMBUSTION, POLLUTION AND CHEMICAL PROCESS CONTROL

GOVERNMENT SUPPORT

The work described herein was supported by Grant No. ISI-8961358 from the National Science Foundation.

BACKGROUND OF THE INVENTION

Combustion of carbonaceous materials, such as coal, oil, natural gas and biomass is the dominant source of energy in today's industrial society. The primary products of combustion are heat, gases and ash. Heat generated by combustion is transferred to a working fluid, such as steam (making the system a "boiler"), which is then transported to a location where it is used to power turbines to produce electricity, drive chemical processes or provide a source of heat. Combustion is also used to incinerate solid municipal wastes. In this case, the primary product is the destruction of the waste, although some "waste-to-energy" systems make practical use of the heat generated by incineration. Combustion gases from boilers and incinerators are injected into the atmosphere after recovering as much heat as possible.

A typical boiler collects heat from both the combustion or furnace section and from the exhaust gas stream. Heat transfer in the furnace is primarily by absorption of the heat by water-cooled walls or tubing.

Combustion furnace designers and operators desire to monitor and control the operation of a boiler so that the performance of the boiler can be optimized and the efficiency of the boiler can be maximized, resulting in more efficient and cost-effective use of resources and less unwanted emissions. In utility boilers, the fraction of heat recovered is maximized when a particular temperature distribution is maintained within the boiler and its downstream recovery apparatus. When combustion temperatures or heat transfer temperatures deviate from this range, more heat is lost up the stack. This occurs, for example, when soot or slag builds up on the heat exchange surfaces of the combustion chamber thereby reducing the efficient transfer of heat to the boiler.

Incinerators for waste to energy production or for waste destruction must maintain minimum combustion temperatures in order to reduce the risk of emission of significant quantities of toxic hydrocarbons and/or chlorinated compounds. Exhaust gas temperatures are generally not monitored in these facilities, therefore procedures for assuring that these temperature requirements are met require use of excessive, and thus wasteful auxiliary fuels.

Certain pollution control systems for boilers or incinerators use a chemical process in the post-combustion zone to reduce the concentration of harmful pollutants. These systems inject urea, ammonia, or other compounds that react chemically with the harmful pollutants in the gas stream, rendering them benign. The reaction occurs within an optimum temperature range. Should these reactions occur at temperatures outside of the optimum range, the pollution reduction could be inadequate and other harmful compounds could be produced.

One of the parameters used to measure and control the efficiency of a boiler is the temperature of the gas exiting the combustion chamber. For many commercial boilers, it is desirable that the exit gas temperature be between about 1000° K. to 1800° K. When the temperature falls below this range, the combustion conditions can be changed to increase the temperature. When the temperature rises above this range, the heat transfer surfaces can be cleaned to improve heat transfer to the boiler. For example, an auxiliary heater is often used to control the temperature of combustion in solid waste incinerators. It is desirable to fire the auxiliary heaters only when necessary and only to the extent required to keep the combustion temperature within the desired range for maximum efficiency.

Attempts at providing reliable and accurate systems for monitoring exit gas temperatures have met with only limited success. Suction pyrometers, also known as high-velocity thermocouple probes, are generally used for this purpose. These devices are essentially thermocouples shielded by water-cooled tubular housings through which the hot exhaust gas is drawn. These devices are difficult to use and are not accurate unless the thermocouple junction is well shielded from the colder furnace walls. The thermocouples cannot withstand continuous exposure to the hot gases, and generally succumb to erosion and breakdown. Another drawback is that these devices only provide a single point measurement, so that several devices must be used to obtain an average gas temperature.

Acoustic pyrometers have also been used. Acoustic pyrometers are based on the premise that the change in the temperature of the gas can be related to the change in the speed of sound. These devices take a measurement across a line of sight to compute an average temperature. Acoustic temperature measurement assumes that the gas molecular weight is fairly constant, however, in practice the amount of moisture and the hydrogen content in the fuel can vary significantly, which renders sonic measurements less accurate. Another drawback is that the acoustic horns used in these devices are subjected to extremely high temperatures and soot and ash deposits which change their sound characteristics. For accurate temperature mapping, multiple horns and detectors are required. Sonic measurement is costly and complex, and requires time consuming signal analysis.

Infrared optical pyrometers have also been used to monitor exit gas temperatures. These pyrometers measure infrared radiation in the boiler exit chamber. However, they cannot distinguish between infrared radiation emitted by the gas and that radiating from the cooler furnace walls, thus, optical infrared pyrometers are not sufficiently accurate for use in industrial monitoring and control systems.

It is an object of the present invention to provide a method and apparatus which exploits an optical temperature monitoring device which accurately measures the temperature of exit gas, which can distinguish between the temperature of the gas and that of the walls, and which can be used to improve the control of a boiler, furnace or incinerator by regulating various combustion, heat transfer, pollution control and/or other chemical process parameters.

SUMMARY OF THE INVENTION

The present invention relates to a system for controlling chemical reactions, including combustion, and the thermal efficiency in a boiler or incinerator by detecting the relative intensities of wavelengths of light emitted from ash particles entrained in the gas stream which exits the combustion chamber. The particles are in thermal equilibrium with the gas, so an accurate measurement of the gas temperature is obtained. The wavelengths of light which are measured are in narrow visible and near infrared (IR) bands, which are selected to discriminate particle radiation from radiation emitted by the cooler furnace walls.

The system comprises a means for detecting the intensity of light within a preselected, narrow band of wavelengths, emitted from ash particles entrained in the combustion product gas stream, a means for generating a signal indicative of the intensity of light detected, and means responsive to the signal for controlling a combustion parameter in an incinerator or heat-transfer in the boiler. This band of wavelengths is preferably within the range of from about 450 nm to about 900 nm and preferably has a bandwidth of about 10 nm. Variations in the intensity of the light within these bands is indicative of temperature changes which, for example, indicate thermal inefficiency in the boiler. In one mode of operation, an increase in the intensity of light emitted from the particles in the selected band of wavelengths indicates an undesirable increase in the temperature of the particles, and thus, of the gas with which they are in equilibrium. This temperature increase in turn indicates that inefficient heat transfer is taking place in the boiler, e.g., due to soot or slag build-up on the heat exchange surfaces. A signal indicative of the intensity of light detected, and thus, the temperature of the gas stream is generated. This signal is used to compute the temperature, which is then transmitted to an operator or to a computer controlled device which activates a means to clean the slag, soot or other deposits from the heat exchange surfaces in the boiler, such as a water lance or soot blower, thereby restoring efficient heat exchange in the boiler.

The present invention provides an accurate system for monitoring efficiency, e.g., the combustion conditions in an incinerator and heat transfer conditions in a boiler. The present invention can also be used to monitor and regulate pollution control systems to maximize efficiency of the systems and thereby reduce emission of pollutants. The optical monitoring device of the present invention can be integrated into a computer or microprocessor-controlled feedback system which automatically activates a secondary system for auxiliary burning or cleaning of the heat exchange surfaces, when the temperature rises or falls outside of the optimal range. The system provides real-time, accurate readings of furnace exit gas temperatures which are substantially free of interference or background noise resulting from the furnace walls, and means for controlling operating parameters to optimize efficient combustion and minimize undesirable emissions.

DETAILED DESCRIPTION OF THE INVENTION

The present invention provides a system for detecting the relative intensities of selected narrow bands of wavelengths of light emitted by ash particles entrained in the gas stream which results from combustion of fuels in a boiler or an incinerator; for processing a signal generated in response to the light which is detected; and for utilizing the signal to regulate the thermal efficiency or other critical operational parameters the boiler or incinerator. The intensity of the light in certain wavelengths emitted by the ash particles is indicative of the temperature of the particles. The ash particles are typically about 20 to 30 microns in diameter and in thermal equilibrium with the surrounding gas within tens of microseconds, thus, an accurate measurement of the temperature of the gas stream as it exits the furnaces can be obtained from the particles.

Figure 1:
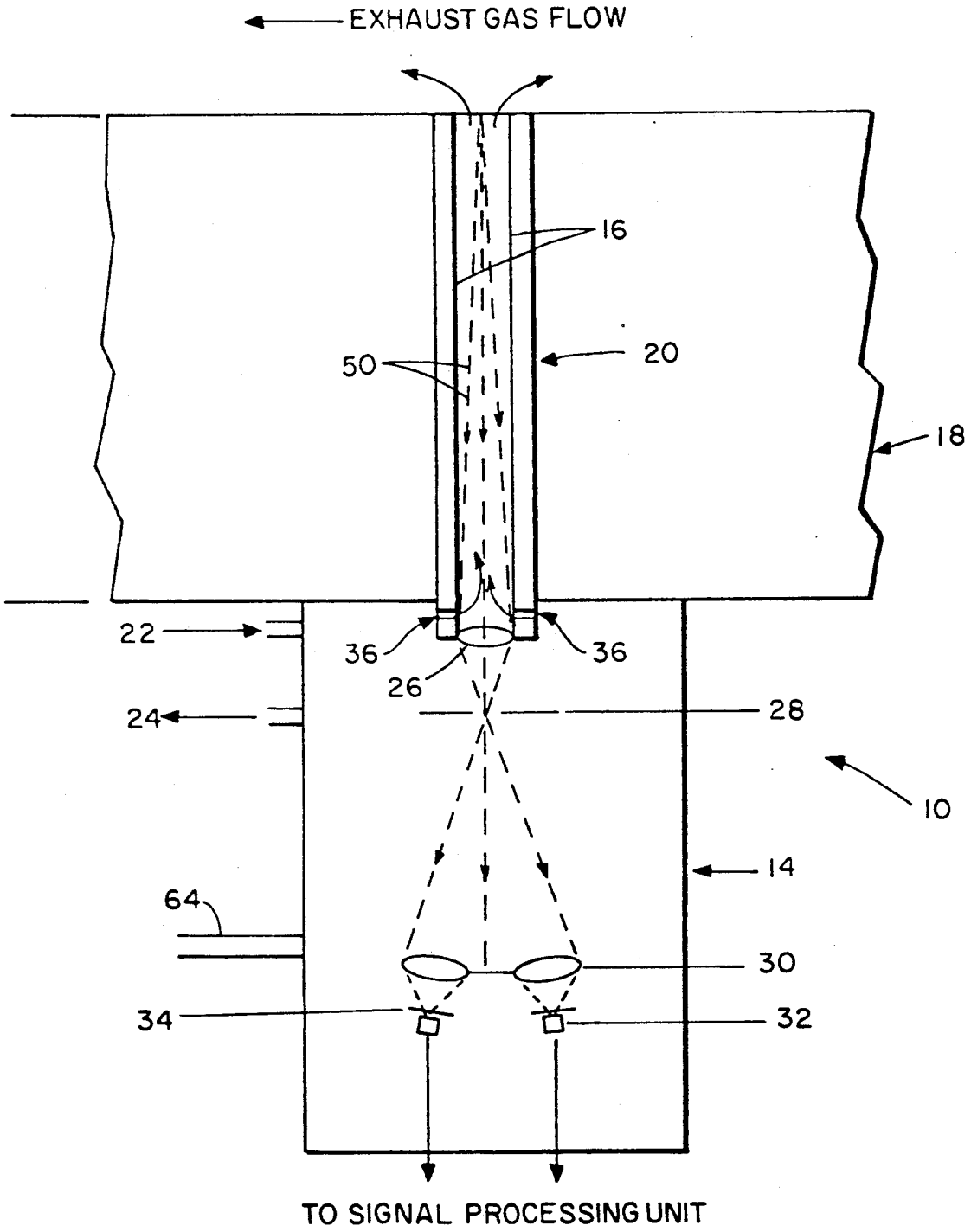
FIG. 1 is a schematic illustration of an optical temperature monitor useful in the apparatus of the invention.

Referring now to the Figures, FIG. 1 shows a schematic representation of an optical temperature monitor 10 according to the present invention. The monitor includes an aperture tube 16 which is inserted into an observation port suitably positioned in a furnace or stack wall 18. The aperture tube 16 preferably is surrounded by a water-cooled jacket 20.

At the end of the tube is objective lens 26. Field stop aperture 28, field lenses 30 and photodetectors 32 are located behind lens 26. Interference filters 34 are mounted in front of photodetectors 32 so that only light of the preselected wavelengths is admitted to photodetectors 32. The device is preferably contained within an air-cooled dust-tight enclosure 14 having an air inlet 64. The enclosure 14 can also contain cooling water inlet 22 and outlet 24 for providing cooling water through a conductor (not shown) to the water jacket 20. Dotted lines 50 represent the light path.

At the end of the aperture tube opposite the furnace side, the tube preferably contains air inlets 36. In the embodiments shown in FIG. 1 air inlets 36 are located in front of lens 26 as shown, and are positioned to direct an air flow from air inlet 64 over the surface of lens 26. The air then exits the tube into the furnace exhaust, thereby creating positive pressure in front of lens 26, which keeps soot and ash particles from being deposited on the lens. Other means of cleaning lens 26, for example a closable shutter or device which wipes the surface clean periodically, can also be used for this purpose.

The device according to the present invention contains at least two field lenses and at least two photodetectors. A preferred configuration contains three field lenses and three photodetectors. The photodetectors are serviced by filters which exclude light having wavelengths outside the range of from about 450 nm to about 900 nm. Each photodetector is filtered to detect a narrow band of wavelengths, or colors, which is different from that detected by the other photodetector(s). In operation, the light shown by dotted lines 50 which is emitted from ash particles is imaged by lens 26 then passes through aperture 28 and is re-imaged by field lenses 30 onto photodetectors 32. Interference filters 34, preferably located between the field lenses 30 and photodetectors 32, limit the light striking each of the photodetectors 32 to the desired wavelengths. The wavelengths are selected to diminish or negate radiation emitted by the furnace walls as disclosed herein. Preferred wavelengths are those in the visible to near IR range, from about 450 nm to about 900 nm. In one embodiment, three photodetectors which detect a specific band of wavelengths having a bandwidth of about 10 nm centered at 600, 650 and 700 nm, respectively. All other light is filtered out by interference filters 34.

Photodetectors 32 generate a signal which is indicative of the relative intensities of the wavelengths of light which strike them. This signal is transported to a processing unit which generates a signal indicative of the temperatures of the ash particles, as shown in FIG. 2.

Figure 2:
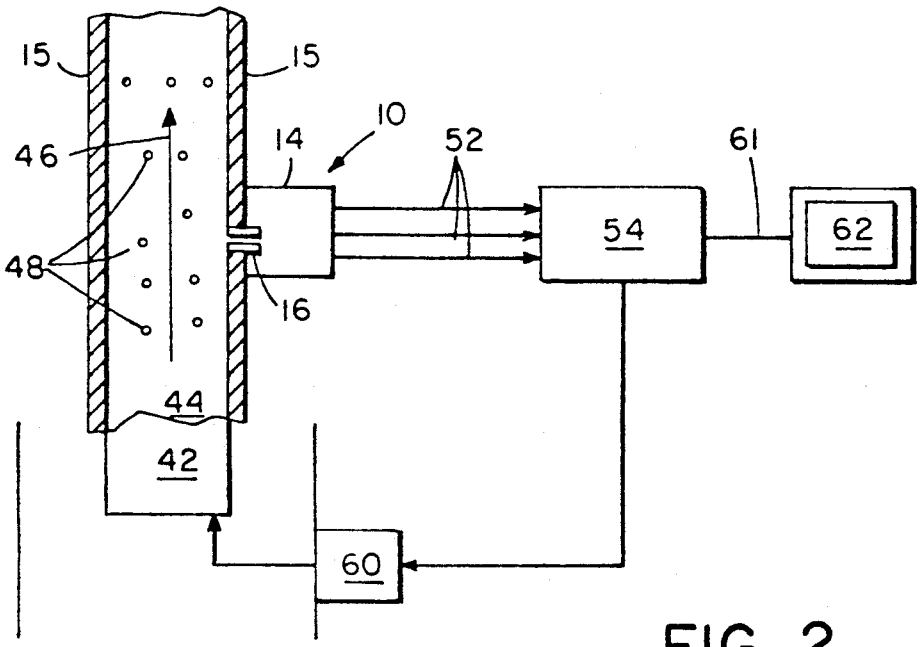
FIG. 2 is a schematic illustration showing the present system installed in the furnace exit of a boiler.

FIG. 2 schematically illustrates the present system mounted in the furnace exit area of a boiler. As shown in FIG. 2, an enclosure 14 containing the optics is mounted on the furnace exhaust stack 15 so that aperture tube 16 traverses the furnace wall. The device is mounted just above combustion chamber 42 and is located such that it is above flame zone 44 where the hot gas stream exits the combustion zone. Ash particles 48 resulting from combustion of the fuel are entrained in gas stream 46.

The intensities of light having the selected wavelengths are converted by the photodetectors into signals which are directed through signal paths 52 into a signal processor 54. The signal processor 54 analyzes the signals and, optionally, computes the temperature of ash particles 48 based on the data. Analysis of the spectral distribution of the radiant energy emitted from the particles enables a computation of the temperature of the gas stream. In one embodiment, in processor 54, analog signals emitted by the photodetectors are amplified and transmitted to an analog-to-digital converter. The digitized signals are then communicated to a computer which computes the temperature of the particles based on the signals.

The temperature data can then be transported via line 61 to a display unit 62 which displays the temperature or time course thereof, or other indicia, thereby prompting an operator to perform an activity to regulate combustion and/or heat transfer. Alternatively, the signal from processor 54 can be delivered via line let to actuate an automated control unit 60 which regulates one or more combustion or heat transfer parameters, e.g., starts an auxiliary burner, or controls a soot blower or a water lance servicing combustion chamber 42.

Theoretical Basis for the Multicolor Optical Pyrometer

If all elements within the enclosed volume comprising the furnace exhaust gases and the surrounding walls were at the same temperature, then the volume would act as a blackbody and the radiant power, $P_i$, incident on a detector would be determined by the Planck equation; and the transmittance of each optical path, $t_i(\lambda)$, where $\lambda$ denotes wavelength, the solid angle $\Omega$ subtended by the optical collection system, and the area, A, of the aperture by the following equation:

$$P_i = \frac{A\Omega C_1}{\pi}\left[\int_0^{\infty} \frac{t(\lambda)d\lambda}{\lambda^5[\exp(C_2/\lambda T) - 1]}\right]_i \quad (1)$$

where $C_1/\pi = 1.191\times10^{-12} W-cm^2/sr, C_2 = 1.44$ cm−K, i denotes the optical path for each photodetector (e.g., if the device contains three photodetectors, then i=1, 2, 3) and T is the temperature. As described below, the central wavelengths, $\lambda_i$, of the bandpass filters have been selected such that $\lambda_i T \geqq 0.3$ cm−K, or $\exp(C_2/\lambda_i T) >> 1$, so that the Planck function can be approximated by the Wien Law: $\exp(C_2/\lambda_i T) - 1 = \exp(C_2/\lambda_i T)$. Furthermore, the bandwidths, $\Delta\lambda_i$, of the filters are small enough to allow its transmission curve to be approximated by a top-hat, that $t_i(\lambda) = t_i$ for $\lambda_i - \Delta\lambda_i/2 < \lambda < \lambda_i + \Delta\lambda_i/2$ and $t_i(\lambda) = 0$ elsewhere. Equation (1) can therefore be accurately approximated as $$P_i = B_i \exp(-C_2/\lambda_i T) \quad (2)$$

where $B_i = A\Omega C_1 t_i \Delta\lambda_i/\pi\lambda_i^5$ is a constant (independent of temperature) that is determined by the optical system and may be evaluated by calibration. Thus, if the furnace exhaust volume was indeed a blackbody radiator, then, by measuring $P_i$, Equation (2) could be used to calculate T.

In practice, because the furnace exhaust gases are not uniformly hot nor are they at the same temperature as the walls, the system is not strictly in thermal equilibrium and, as a result, radiant energy transfer occurs among its various portions. Planck's equation is not strictly valid under these conditions, so Equation (2) cannot be used directly to evaluate the particle-laden gas temperature without careful consideration of the effects of these temperature differences.

Nevertheless, a reasonable approximation of the system can be made by assuming that the particle-laden gas is of uniform temperature and radiates as a partially transparent hot volume with temperature $T_p$, while the cooler walls radiate like a blackbody with temperature $T_w$. The radiant energy incident upon the pyrometer's aperture can then be considered to be the sum of the separate contributions from the particles in the gas and from the walls, taking into account the fact that the particles partially obscure the walls. The innovative key to the present system is to select wavelengths that, under typical furnace operating conditions, make the radiant energy contributions from the walls insignificant compared to those from the particles, and then to use Equation (2) to determine the temperature.

An approximation of the energy that enters the pyrometer's aperture assumes that the gas itself is transparent, i.e., it absorbs and emits no energy at the wavelengths of interest, and that the particles, of number density n $cm^{-3}$ and having uniform radii r (the radii of the particles are assumed to be uniform; although this is not the case, it provides a useful approximation) and cross-sections $\sigma = \pi r^2$, are large compared to those wavelengths. Each ray emitted by the wall that strikes a particle is blocked by that particle. The fraction of rays from the wall that reach the pyrometer is given by $f_w = \exp(-\propto 1)$ where $\propto = n\propto$ is the extinction coefficient of the particle cloud and 1 is the path length through the cloud between the wall and pyrometer. The complementary fraction of rays, $f_p = 1 - f_w$ emanate from the particles. Thus, in this illustration, the total power incident on each photodetector is separated into two contributions:

$$P_i = B_i[f_p \exp(-C_2/\lambda_i T_p) + (1 - f_p)\exp(-C_2/\lambda_i T_w)] \quad (3)$$

where the first term represents the contribution from the particle cloud, and the second term represents the fraction of radiation that is emitted by the walls which passes through the cloud to reach the pyrometer.

Because this illustration ignores interparticle scattering, radiant heat transfer among particles and the wall, and the true polydispersity of the particles, it would be unreasonable to attempt to direct calculation of $f_p$. Nevertheless, when the cloud is sufficiently dense, it is reasonable to assume that $f_p > 0.1$. Furthermore, examination of Equation (3) shows that if $T_w < T_p$, then the contribution of the second term, representing the wall radiation, can be made negligibly small compared to the particle radiation manifested in the first term by selecting a sufficiently short wavelength. Under these conditions, the radiant power detected at each wavelength is given by $$P = \epsilon_i B_i \exp(-C_2/\lambda_i T) \quad (4)$$

where $\epsilon_i$ is the effective emissivity of the ash cloud and is roughly the same magnitude as $f_p$. (Note that when there is considerable interparticle radiation transfer, as in a dense ash cloud, the effective cloud emissivity is only weakly related to the emissivity of an individual particle.)

Like $f_p$, the effective cloud emissivity cannot be calculated a priori. However, temperatures can be deduced approximately despite poor knowledge of the emissivity. If done correctly, the approximations quite accurately represent the true temperature. To this end, it is assumed that the emissivity at two closely-spaced wavelengths, $\lambda_1$ and $\lambda_2$, is constant (the gray-body assumption). The temperature is then determined from the ratio of the power detected at those two wavelengths:

$$P_1/P_2 = (B_1/B_2)\exp[(C_2/T)(1/\lambda_2 - 1/\lambda_1)] \quad (5)$$

After calibration of $B_1$ and $B_2$, Equation (5) is solved to yield the temperature upon measurement of $P_1/P_2$. The assumption of wavelength-independent emissivity is a good one here because at the visible wavelengths employed by the optical monitor, the interparticle radiation transfer removes the effect of inherent particle emissivities leaving the effective cloud emissivity dependent only on the particles sizes and number densities. The effective emissivity is therefore at most only weakly dependent on wavelength, and the gray body assumption is valid for closely spaced wavelengths. Thus, the key to accurately measuring furnace exhaust gas temperatures is to measure radiation from ash particles using a two (or more) color ratio pyrometer where the wavelengths have been selected to make negligible the radiation from the walls.

Utility

The present system provides a non-intrusive, rapid response optical instrument which can monitor continuously and ultimately control the furnace exit gas temperature (FEGT) in energy plants and incinerators, particularly those which burn fossil fuels, coal or combustible wastes. The invention can also be used to monitor pollution control devices in these plants. The present system can be used in most chemical process plants in which ash-laden exhaust gas streams are produced.

Steam boiler furnaces are designed to maximize the efficiency of heat transfer to the working fluid. Heat transfer in a furnace is calculated based on the flame temperature, furnace configuration, and assumed ash and slag deposition on the walls. These calculations yield a design value of the FEGT that is used to design the convective heat transfer sections of the system. Off design operation can occur when the heat transfer rates in the furnace or convective sections change as a result of fuel changes, burner fouling or ash and slag deposits on the furnace walls. These conditions are manifested by changes in the FEGT, which the present system can sense.

The information can then be used to direct a furnace controller or controller personnel to adjust the combustion conditions, e.g., turn on an auxiliary burner, or to clean the heat exchange surfaces in the boiler e.g., by activating a soot blower or a water lance. Alternatively, the information can be used to automatically activate the appropriate controls.

Since most of the steam generation in a boiler occurs at the furnace walls, an increase in furnace efficiency causes a decrease in FEGT. This can be damaging to the boiler since the increased radiation heat transfer causes high steam flow rates. Lower FEGT diminishes the ability to superheat the steam in the convective heat transfer sections. The resulting low steam temperatures can lead to early condensation and, in power generation plants, reduce turbine efficiency and contribute to erosion of steam turbine blades by water droplet impacts. Conversely, a low furnace efficiency, manifested by high FEGT, will result in low steam generation rates and high superheated steam temperatures. A low steam flow rate reduces power output from a turbine causing loss of income to a power generation utility.

Depending on the facility, control of the FEGT is achieved by recirculating flue gases into the furnace, by removing the ash deposition from the furnace walls, and/or by changing the air/fuel mixture. For example, ash buildup impedes radiation and convective heat transfer. Ash is removed by "soot blowing", that is, blowing the ash deposits off the wall using air, water or steam. Soot blowing operations are usually performed periodically in most boilers, but the frequency is based on operating experience rather than by direct measurements of heat transfer efficiency, resulting in the furnace being operated above and below optimum efficiency most of the time.

The present device can be used to continuously monitor the FEGT, or other temperature parameters if desired, so that the furnace can be operated at or near optimal efficiency all of the time. An example of the use of the present system to activate soot blowing when the FEGT rises above a preset value is illustrated in the Exemplification.

The present system can be permanently installed into utility boilers and used to control automatically or manually the combustion process. A one percent improvement in the availability of a 100 MW coal fired utility steam generator used for power generation can save several million dollars per year.

In waste destruction facilities (i.e., incinerators), the critical temperature history of the exhaust gases is controlled by the firing rate of the primary burner. Since the quality of the fuel cannot be easily controlled, the heating value of the fuel or fuel availability may be insufficient to maintain the required exhaust temperature. Supplemental fuels, such as natural gas or fuel oil are used to raise the furnace temperature during these periods. To provide a margin of safety, the target temperatures in waste destruction plants are raised by 5 to 10 percent above their required values, which results in unnecessary support fuel costs and concomitant increased operating costs. The present system can be used to provide reliable and continuous FEGT measurements, thereby increasing incinerator efficiency and reducing costs. For example, the temperature measurement obtained by the optical device could be coupled to the combustion control system to control fuel feed rate. If the FEGT dropped below a preset value, then auxiliary support fuel combustion would be started.

Many boilers are equipped with pollution control systems that inject chemicals into the post-combustion region. These chemicals react with harmful pollutants in the exhaust gas, converting them into benign compounds. The chemical reactions are temperature dependent, and when improperly controlled, such systems produce undesirable by-products.

The performance of these systems is measured by the degree of pollution reduction and amount of undesirable by-product production, which are strongly affected by the reaction temperature. For example, in systems that reduce nitrogen oxide (NO) concentrations in exhaust gas by injecting urea or ammonia, the effectiveness of NO reduction diminishes when the temperature rises above the optimum range. When the temperature falls below optimum, ammonia and other undesirable species are emitted. Thus, the pollution control operator or system may wish to change chemical parameters, such as injection rate or species, in response to changes in boiler operating conditions as manifested by a change in exit gas temperature. The present invention allows the exit gas temperature to be closely monitored so that the combustion conditions can be controlled to maintain the optimum exit gas temperature required for effective pollution control.

Other chemical processes that will benefit from the present invention include: steel production, chemical refining, and other processes requiring temperature monitoring in harsh, particle-laden gas environments.

The present system avoids the problems associated with using thermocouples, acoustic pyrometers or other temperature measuring devices. These problems include short life span in the harsh environment of the furnace and the inability to distinguish between the actual temperature of the gas stream and the temperature of the furnace walls, which are usually much cooler.

The present invention will be further illustrated by the following exemplification.

EXEMPLIFICATION

The operation of the present optical temperature system was demonstrated in a coal-fired boiler of an electric generating station. The present optical monitor was compared to a high velocity thermocouple (HVT) during various furnace operating conditions.

The Instrument

The optical temperature monitor used in the tests is illustrated schematically in FIG. 1. It contained three independent photodetectors 32, each filtered to be sensitive to a different wavelength from the others, and all served by a single, air-purged objective lens 26 located at one end of a water-cooled aperture tube 16. The aperture was 20 mm in diameter, and was imaged by the objective lens 26 with ⅓ magnification onto the field stop 28. The field stop 28 was then imaged, again with ⅓ magnification, by the three field lenses 30, onto three silicon photodiodes 32 having 2.54 mm diameter sensitive areas, and combined with integral operational amplifiers to minimize noise. The field lenses were mounted at the vertices of an equilateral triangle on a plate. The photodiodes (photodetectors) 32 were mounted on an additional plate behind the lenses. Interference filters 34 having central wavelengths of 600, 650 and 700 nm with bandwidths of about 10 nm were mounted between the field lenses 30 and the photodiodes 32. The photodiode amplifiers were powered by a ±15 volt dc power supply.

The output signals from the amplifiers were transported to a computer (Compaq personal computer) equipped with a Data Translation Model 2801A multichannel high speed 12 bit analog-to-digital acquisition board. This data acquisition board included an amplifier with a self-adjusting gain of 1, 2, 4 and 8, yielding 15 bits of dynamic range, which spans the 1000°to 1800° K. range of temperature measurements demanded of the pyrometer. Software to operate this board, to acquire data and to analyze it was written in the compiled BASIC language using, as needed, subroutines from Data Translation's PCLAB library package. The program was based on the equations set out in the theory section hereinabove. Many other implementary programs could be designed by those skilled in the art in view of the equations set out in the specification. The computer was programmed to calculate the apparent temperature using data from each pair of photodiodes, and also used an algorithm to use all three photodiodes to deduce another approximation of the temperature when the emissivity varied slightly with wavelength. The computer and data acquisition board were also programmed to provide an output voltage signal representative of the calculated temperature. This signal can be coupled to a furnace control system, most of which accept a standard 4 to 20 mA signal.

The instrument was packaged to withstand and operate continuously within the harsh, dust-laden environment of the power plant, which can have ambient temperatures up to 150° F. Except for the objective lens, all optics and electronics were totally enclosed in a heavy duty, dust-tight box. The water-cooled aperture tube can be inserted permanently into a boiler observation port. The objective lens was recessed in the tube and was kept clean by a continuous air purge. The purge air exited the tube at the aperture, and its pressure was adjusted to prevent dust from entering the tube.

Calibration

The instrument was calibrated using an Infrared Industries Model 463 blackbody source operable at temperatures between 300° and 1273° K. The source was accurately aligned with the optical axis of the pyrometer and its aperture diameter adjusted so that its image filled the pyrometer's field stop. The temperature of the blackbody was set and allowed to reach a steady value, which was measured by a platinum/platinum-rhodium (13 percent) thermocouple and ice point reference. The voltages produced by the three photodiodes were measured by the computer-coupled data acquisition system with a precision of 0.030 mV.

The detector voltages were plotted versus $\exp(-C_2/\lambda_i T)$. The relationship between the two parameters was linear over the entire temperature range. The slope of the line was the calibration constant, $B_i$. After least squares fitting of the straight lines, the calibration constants were found to be:

$$B_{600} = 1.23 \times 10^7 V.$$

$$B_{650} = 2.30 \cdot 10^6 V$$

and $$B_{700} = 6.15 \cdot 10^5 V$$

Because the outputs of the photodiode/op-amp combinations increase linearly in proportion to the input radiant power over move than seven orders or magnitude, these calibration constants are valid throughout the 15 bit dynamic range of the data acquisition system.

Data Reduction

The pyrometer was built with three colors to provide some flexibility in optimizing the choice of colors (wavelengths) to be used for the furnace exit gas temperature (FEGT) measurements and, if needed, to help overcome the effects of temperature inhomogeneities as described above. The data reduction algorithm was as follows: upon measuring the voltage signals from the three photodetectors, the ash temperature as a function of effective emissivity for each wavelength was calculated using Equation 4. The calculation provided three curves. If the emissivity of the ash laden gas stream was truly independent of wavelength (Equation 5), then these three curves would intersect at a single point corresponding to the correct values of temperature and emissivity. If, however, the apparent emissivity varies somewhat as a function of wavelength (due, perhaps, to non-uniform temperature), then the three curves intersect at three points. Each intersection of two curves provides a "two color" emissivity and temperature value equivalent to that which would be calculated. Furthermore, for each value of emissivity, an average temperature and a standard deviation around that average was calculated from all three curves. The temperature that has the smallest standard deviation was chosen to be the "three-color" temperature.

Operation In The Power Plant

Operation of the optical monitor was demonstrated at a coal fired commercial power station. The goals of the tests were to compare results of the present optical monitor system with those of a high velocity thermocouple (HVT) probe during various furnace operating conditions. The monitor was mounted in a port on level 7.5 (elevation 115 ft) in the unit. There were no physical obstructions between this port and a furnace division wall located 20 feet away. However, there was a set of screen tubes just to the left of the port. The optical monitor was angled away from the tubes to assure that their presence did not affect the measurements.

Figure 3:
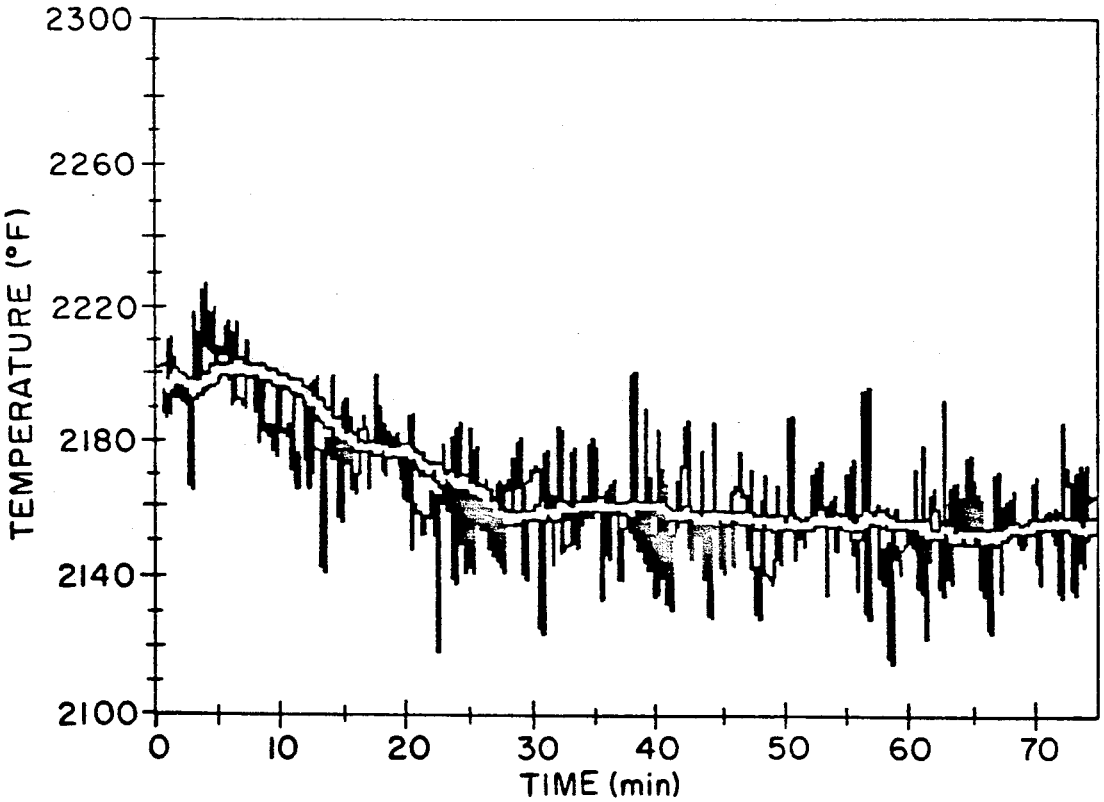
FIG. 3 is a graph showing the furnace exit gas temperature (FEGT) temperature in a coal-fired boiler during operation.

FIG. 3 shows 75 minutes of temperature data collected by the optical monitor. The instantaneous temperature was determined approximately five times per minute. These instantaneous values are all plotted, and a curve showing a running average of the previous 10 minutes was superimposed on them. Each instantaneous temperature shown is the mean of the three "two color" temperatures described previously. Usually the spread among the three values was less than 25° F. The three-color temperature was typically within 5° F. of the mean instantaneous two color temperature average.

It is clear in FIG. 3 that, though the instantaneous measurement displays ±50° F. fluctuations, the 10 minutes running average is quite smooth. In the first 25 minutes of the run it decreased from a steady value of about 2200° F. for the first 10 minutes to a final steady value of 2160° F. This drop in FEGT was caused by a change in the furnace operating conditions. During the initial 10 minute period the furnace was operating at 158 MW load using approximately 3.6 percent $O_2$. In the period of 10 to 25 minutes after the start of the run, the oxygen concentration was decreased to about 2.0 percent. According to the furnace operator, the effect of decreasing the $O_2$ is to increase the flame temperature by about 150° F., thereby increasing the efficiency of radiative heat transfer to the furnace walls and thus decreasing the temperature of the furnace exhaust gases by about 50° F. A change of this magnitude is clearly evident from the data, demonstrating the optical probe's sensitivity to subtle changes in furnace operating conditions.

Figure 4:
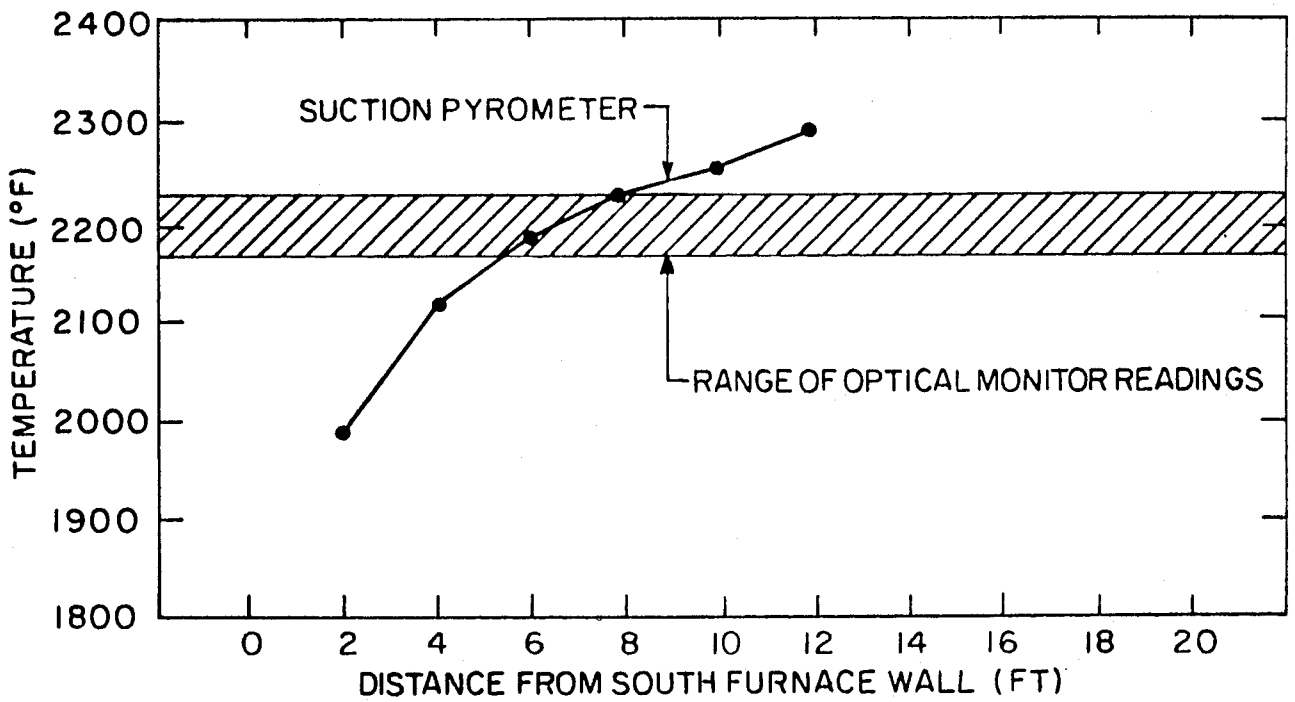
FIG. 4 is a graph showing the FEGT temperature in a coal-fired boiler as detected by the present optical monitor system compared to the temperatures detected by an HVT probe.

During the first 10 minutes of this run, the temperature distribution in the exhaust gases was also sampled with an HVT probe. These measurements are plotted in FIG. 4 and compared with the present optical monitor's measurements. The average temperature measured by the optical monitor appears to represent the actual temperature near the center of the furnace quite well. Furthermore, the range of instantaneous fluctuations sensed by the optical monitor all fall within the range of temperatures measured by the HVT probe as it was traversed from the furnace wall to the center of the flue.

Figure 5:
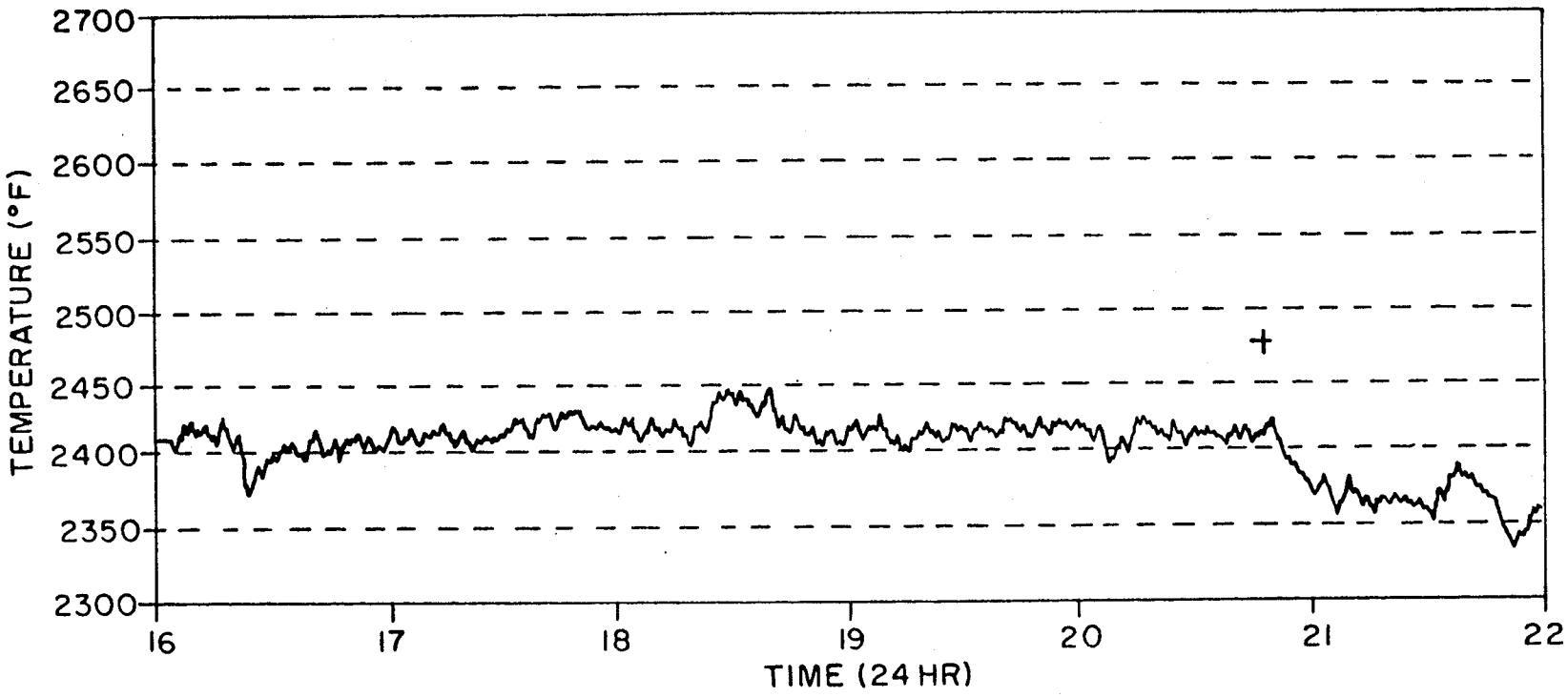
FIG. 5 is a graph showing the change in temperature obtained using the present optical monitor system before, during and after one soot blowing operation.

FIG. 5 shows the change in temperature which occurred during and after a soot blowing operation. The graph shows that the FEGT was about 2400°-2425° F. prior to soot blowing. The soot blowing operation was commenced just before hour 21. After soot blowing was completed, the FEGT dropped below 2350° F.

Figure 6:
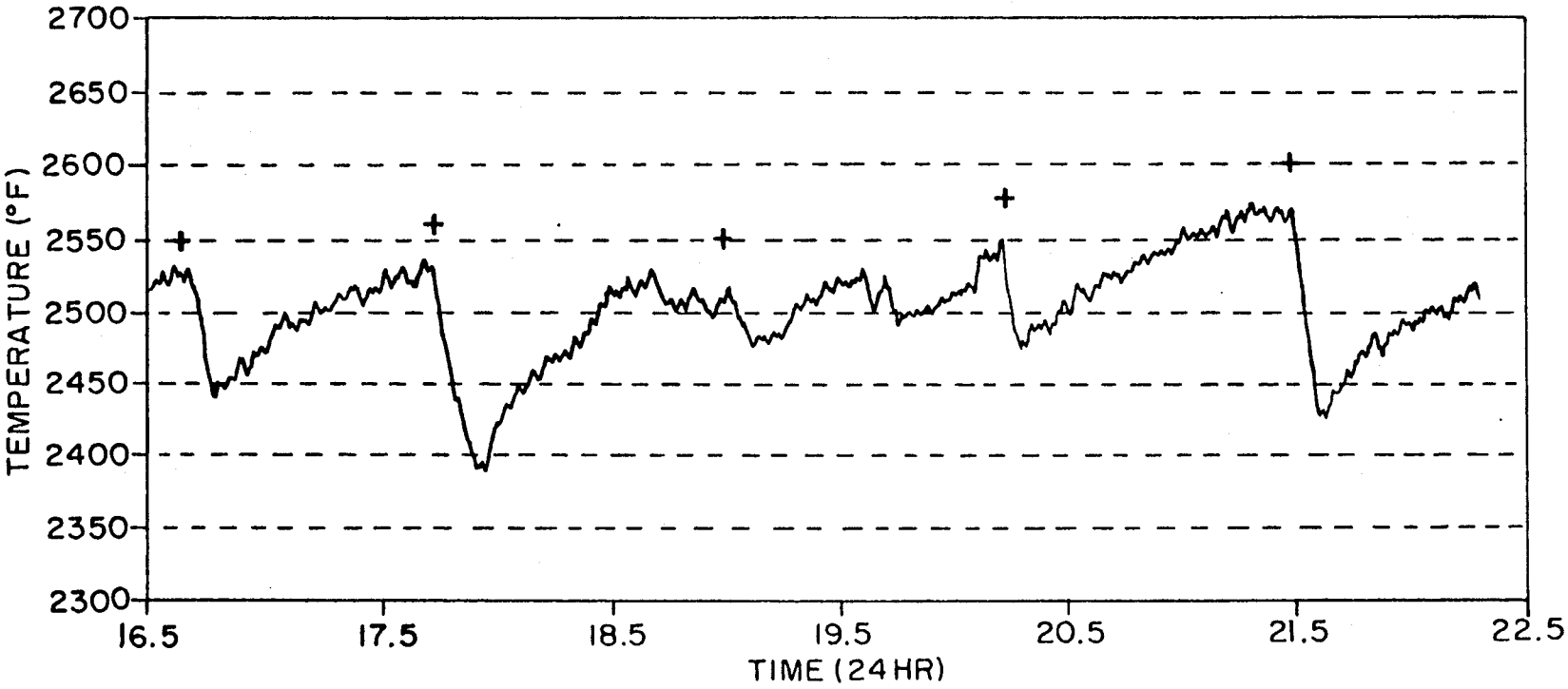
FIG. 6 is a graph showing the change in temperature obtained using the present optical monitor system before, during and after several soot blowing operations.

FIG. 6 shows a graph of the change in temperature after several soot blowing operations. In each case, the exit gas temperature decreased after soot blowing was performed. These results show that continuous measurements of FEGT can be made to monitor and control combustion and/or heat transfer operations such as soot blowing.

During the power station tests, the mechanical features of the monitor performed as designed; the temperature of the water exiting the aperture tube never exceeded 95° F., the objective lens remained clear at all times. The instrument remained installed throughout at least one soot blowing operation with no adverse effects. Changes of the air temperature within the device's enclosure also had no effect on its operation. The instrument required no special attention other than connection to water, air, and electrical outlets already existing in the plant.

Equivalents

One skilled in the art will be able to ascertain many equivalents to the specific embodiments described herein. Such equivalents are intended to be encompassed by the scope of the following claims.

I claim:

1. A system for controlling operating parameters of a combustion process yielding products including flowing gases having particles entrained therein, said system comprising:

a. plural photodetectors for detecting preselected wavelengths of light emitted from particles entrained in the combustion product gas stream, wherein the intensities of the light at said preselected wavelengths are indicative of inefficiencies in the combustion process, and wherein each photodetector detects a band of wavelengths of light different from the others; and b. means for generating a signal indicative of the intensities of light at said wavelengths detected by the photodetectors, for indicating the presence of inefficiency.

2. The system of claim 1 further comprising means responsive to the signal generated in step (b) for controlling the operating parameter in the combustion process.

3. The system of claim 2 wherein the means responsive to the signal comprises a signal processor.

4. The system of claim 2 wherein the operating parameter comprises an auxiliary burner.

5. The system of claim 2 wherein the operating parameter comprises a pollution control system.

6. The system of claim 5 wherein the pollution control system comprises a means for injecting a pollution control chemical or chemicals into the flowing gases thereby converting harmful compounds in the gases to benign compounds.

7. The system of claim 6 wherein the pollution control chemical comprises ammonia or urea.

8. The system of claim 1 wherein the relative intensities of the wavelengths of light detected are indicative of the temperature of the entrained particles.

9. A system for controlling thermal efficiency in a boiler having a heat exchange surface and combustion products including flowing gases having particles entrained therein, said system comprising:

a. plural photodetectors for detecting preselected wavelengths of light emitted from particles entrained in the combustion product gas stream, wherein the intensities of the light at said preselected wavelengths are indicative of thermal inefficiency in the boiler, and wherein each photodetector detects a band of wavelengths of light different from the others; and b. means for generating a signal indicative of the intensities of light at said wavelengths detected by said photodetectors, for indicating the presence of inefficiency.

10. The system of claim 9 further comprising means responsive to the signal generated in step (b) for controlling a combustion parameter or heat transfer in the boiler.

11. The system of claim 10 wherein the relative intensities of the wavelengths of light detected are indicative of the temperature of the entrained particles.

12. The system of claim 10 wherein the wavelengths of light detected are within the range from about 450 nm to about 900 nm and each photodetector detects a band of light having a bandwidth of about 10 nm.

13. The system of claim 10 wherein the means responsive to the signal comprises a signal processor.

14. The system of claim 10 wherein the means for controlling comprises a means for cleaning the heat exchange surface of the boiler.

15. The system of claim 14 wherein the means for cleaning the heat exchange surface of the boiler is selected from the group consisting of a soot blowing device and a water lance.

16. The system of claim 9 wherein the boiler is adapted for combustion of a fuel selected from the group consisting of coal and solid waste products.

17. A method of regulating thermal efficiency in a boiler having a heat exchange surface and combustion products including a gas stream having particles entrained therein, comprising the steps of:

a. detecting preselected wavelengths of light emitted from particles entrained in the combustion product gas stream by separately detecting light using plural photodetectors each of which detects a band of wavelengths of light different from the others, wherein the relative intensities of light at said preselected wavelengths are indicative of thermal inefficiency in the boiler;

b. generating a signal indicative of the relative intensities of light at said wavelengths detected for indicating the presence of inefficiency; and c. analyzing the signal obtained in step (b) and utilizing the analysis obtained thereby for regulating a combustion parameter of heat transfer in the boiler.

18. The method of claim 17 wherein the wavelengths of light detected are within the range from about 450 nm to 900 nm and each photodetector detects a band of light having a bandwidth of about 10 nm.

19. The method of claim 17 wherein step (c) is performed by analyzing the signal obtained in step (b) with a signal processor and applying the analysis obtained to initiate cleaning a heat exchange surface of the boiler.

20. The method of claim 19 wherein the cleaning is performed using a member selected from the group consisting of a soot blowing device and a water lance.

21. The method of claim 17 wherein the boiler is adapted for combustion of a fuel selected from the group consisting of coal and solid waste products.

22. A device for controlling thermal efficiency in a boiler having a heat exchange surface and combustion products including a gas stream having particles entrained therein, comprising:

a. plural photodetectors which are capable of selectively detecting specific wavelengths of light emitted from ash particles in the combustion product exhaust, wherein each photodetector detects a band of wavelengths different from the others;

b. means for generating a signal indicative of the relative intensities of the specific wavelengths of light detected; and c. a signal processor for analyzing the signal obtained in step (b) and for producing an output signal useful to control at least one combustion or heat transfer parameter.

23. The device of claim 22 wherein the bands of wavelengths of light detected are within the range from about 450 nm to about 900 nm having a bandwidth of about 10 nm.

24. The device of claim 22 wherein the photodetectors comprise photodiodes.

25. The device of claim 22 further comprising means responsive to the output signal for automatically initiating a decrease in furnace exit gas temperature.

26. The device of claim 23 wherein the means responsive to the output signal comprises a means for cleaning the heat exchange surface of the boiler.

27. The device of claim 26 wherein the means for cleaning the heat exchange surface comprises a soot blowing device or a water lance.

28. A device for detecting preselected wavelengths of light emitted from ash particles entrained in combustion product gas streams of a boiler, comprising:

a. an aperture tube which mates with a combustion product exit stack;

b. an objective lens disposed to receive light from said aperture tube;

c. at least two field lenses which image light from the objective lens;

d. at least two photodetectors which detect separate wavelengths of light passing through the field lenses; and e. means for converting the light detected to signals indicative of the temperature of the ash particles.

29. The device of claim 28 wherein each photodetector detects a band of wavelengths of light different from the others.

30. The device of claim 28 further comprising means for transporting the signal indicative of the temperature of the ash particles to a boiler efficiency control device.

31. An exit stack of a combustion chamber containing the device of claim 22.

32. An exit stack of a combustion chamber containing the device of claim 28.

* * * * *